US006102763A

United States Patent [19]

Cueni et al.

[11] Patent Number: 6,102,763

[45] Date of Patent: Aug. 15, 2000

[54] PROCESS FOR PRODUCING A QUADRUPOLE ELECTRODE ARRANGEMENT

[76] Inventors: Hansjörg Cueni, Kleebodenweg 6, CH-4222 Zwingen, Switzerland; Heiner Scherrer, Grabenackerstrasse 11, CH-4227 Büsserach, Switzerland

[21] Appl. No.: 09/214,528

[22] PCT Filed: Jul. 10, 1997

[86] PCT No.: PCT/CH97/00264

§ 371 Date: Feb. 3, 1999

§ 102(e) Date: Feb. 3, 1999

[87] PCT Pub. No.: WO98/01888

PCT Pub. Date: Jan. 15, 1998

[30] Foreign Application Priority Data

Jul. 10, 1996 [CH] Switzerland ..... 1729/96

[51] Int. Cl.[7] ..... H01J 49/42; H01J 9/14

[52] U.S. Cl. ..... 445/47; 250/292

[58] Field of Search ..... 250/292; 445/47

[56] References Cited

U.S. PATENT DOCUMENTS 4,158,771 6/1979 Beeck et al. ..... 250/294

5,559,327 9/1996 Steiner ..... 250/292

*Primary Examiner*—Kenneth J. Ramsey

*Attorney, Agent, or Firm*—Ladas & Parry

[57] ABSTRACT

The invention relates to a quadrupole electrode arrangement comprising two shaped parts (10, 11). Each shaped part (10, 11) is produced from an insulating plate-shaped carrier (2) and a metal blank (1) fastened thereto. Each two of the four opposing electrode surfaces (4.1–4.4) are, for example, milled, turned and ground from the metal blank. Each shaped part (10, 11) also has a ground connection surface (6.1, 6.2) which defines the distance of the quadrupole electrode pairs precisely when the two structural parts are joined.

13 Claims, 3 Drawing Sheets

FIG. 1A
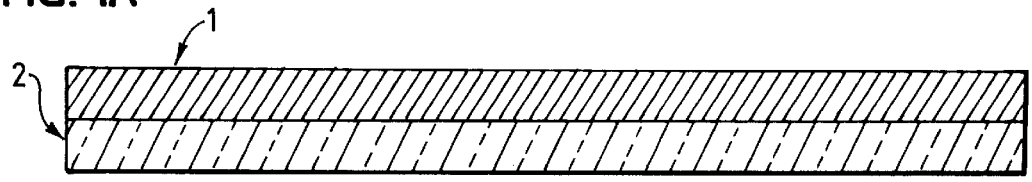
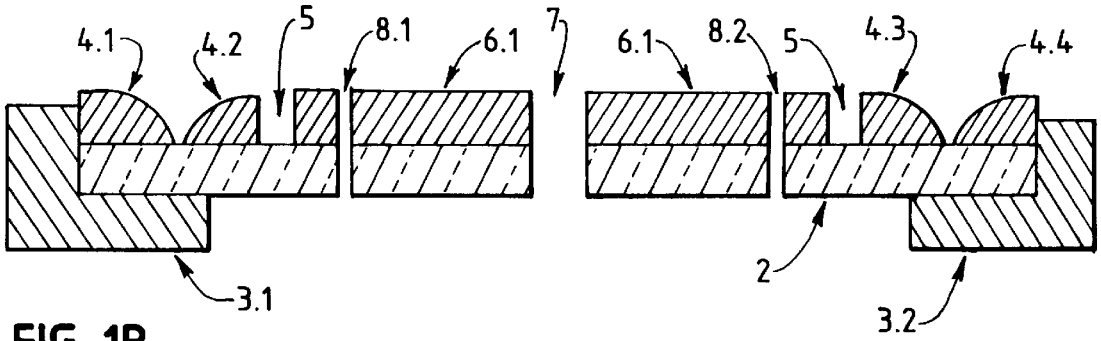
FIG. 1B
FIG. 1C
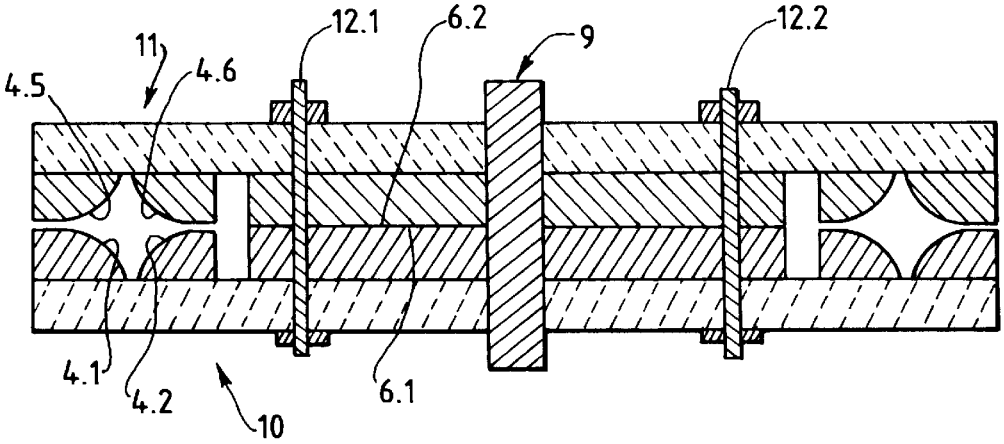

PROCESS FOR PRODUCING A QUADRUPOLE ELECTRODE ARRANGEMENT

TECHNICAL FIELD

The invention relates to a process for producing a quadrupole electrode arrangement and to a quadrupole electrode arrangement and a mass spectrometer.

STATE OF THE ART

Mass spectrometers are known in a variety of designs and are used for the analysis of chemical structures (cf e.g. U.S. Pat. No. 5,389,785, U.S. Pat. No. 5,298,745, U.S. Pat. No. 4,949,047, U.S. Pat. No. 4,885,470, U.S. Pat. No. 4,158,771 or U.S. Pat. No. 3,757,115). In principle, such instruments have an ion source, one (or more) ion filters and an ion detector. The gaseous ions are selected by the ion filter, which is typically formed of a quadrupole electrode arrangement with hyperbolically shaped surfaces. It is important for the hyperbolic surfaces to be made with very high precision and to be the right distance apart. In particular, precise positioning of the electrode surfaces has presented considerable difficulties hitherto.

DESCRIPTION OF THE INVENTION

The object of the invention is to provide a process for producing quadrupole electrode arrangements for mass spectrometers and the like which affords a high precision of the electrode arrangement while incurring the lowest possible expenditure on assembly.

The solution according to the invention is defined by the features of claim 1. The quadrupole is thus produced essentially from two shaped parts, each of which has two electrode surfaces machined out of it and at least one coupling surface. The two parts are shaped so that they can be placed directly against one another and joined together via the coupling surfaces. In the joined state, the two electrode pairs are exactly the right distance apart. The invention makes use, inter alia, of the fact that an individual shaped part can be produced with very high precision, e.g. by turning, milling and/or grinding. Machining two electrode surfaces out of one shaped part ensures that at least these two electrode surfaces are the right distance apart.

In a preferred embodiment, the two shaped parts are formed essentially of a plate-shaped carrier and a shaped block fixed thereto. The carrier is made of an insulating material, e.g. glass, and the block is made e.g. of a conducting material, for example stainless steel or aluminum. In the manufacturing process according to the invention, the block is fixed to the carrier in the raw state (i.e. as a blank) and then machined. Accordingly, for example, half of the quadrupole interior chamber is hollowed out of a steel plate by turning so that the interior chamber of the quadrupole electrode arrangement is created when the two parts are joined together. Feed lines can also be attached to the steel plate for evacuation of the interior chamber. The important aspect is that two electrode surfaces and a coupling surface can be produced in a single chucking.

Instead of a metal plate, it is also possible to use a ceramic plate; after the electrode surfaces have been shaped, this is selectively provided with a conducting layer (of copper, gold, platinum etc.).

The two shaped parts are advantageously formed with mirror symmetry. The process is particularly suitable for producing ion filters curved in the shape of a circular arc.

Precision lathes are particularly good at producing circular shapes. However, the invention is also advantageous in the case of linear electrode arrangements.

So that two disk-shaped parts can be joined together with precision, each one is provided e.g. with a central bore. The two carriers can be mutually aligned with an expanding arbor.

With a quadrupole electrode arrangement produced according to the invention, it is also easy to seal the interior chamber between the electrodes so that the required high vacuum can subsequently be created. It is also possible to mill radial slots in the plates, into which ion lenses can be inserted at a later stage.

A mass spectrometer according to the invention comprises an ion source, a quadrupole electrode arrangement with electrodes curved in the shape of a circular arc, and a detector. There is also a vacuum pump for evacuation of the quadrupole interior chamber. Preferably, this is at least partially built into the double plate arrangement. In a particularly preferred embodiment, the double plate arrangement has several sectors separated by ion lenses. One of these can be filled with a gas to act as a collision cell (for breaking the incoming ions down into several individually analyzable components).

Further advantageous embodiments and combinations of features can be found in the following detailed description and in the claims taken as a whole.

BRIEF DESCRIPTION OF THE DRAWINGS

In the drawings used to illustrate the Examples:

FIGS. 1*a–c* are a schematic representation of the steps of the manufacturing process;

In the drawings, identical parts always carry identical reference numbers.

MODES OF CARRYING OUT THE INVENTION

Figure 2:
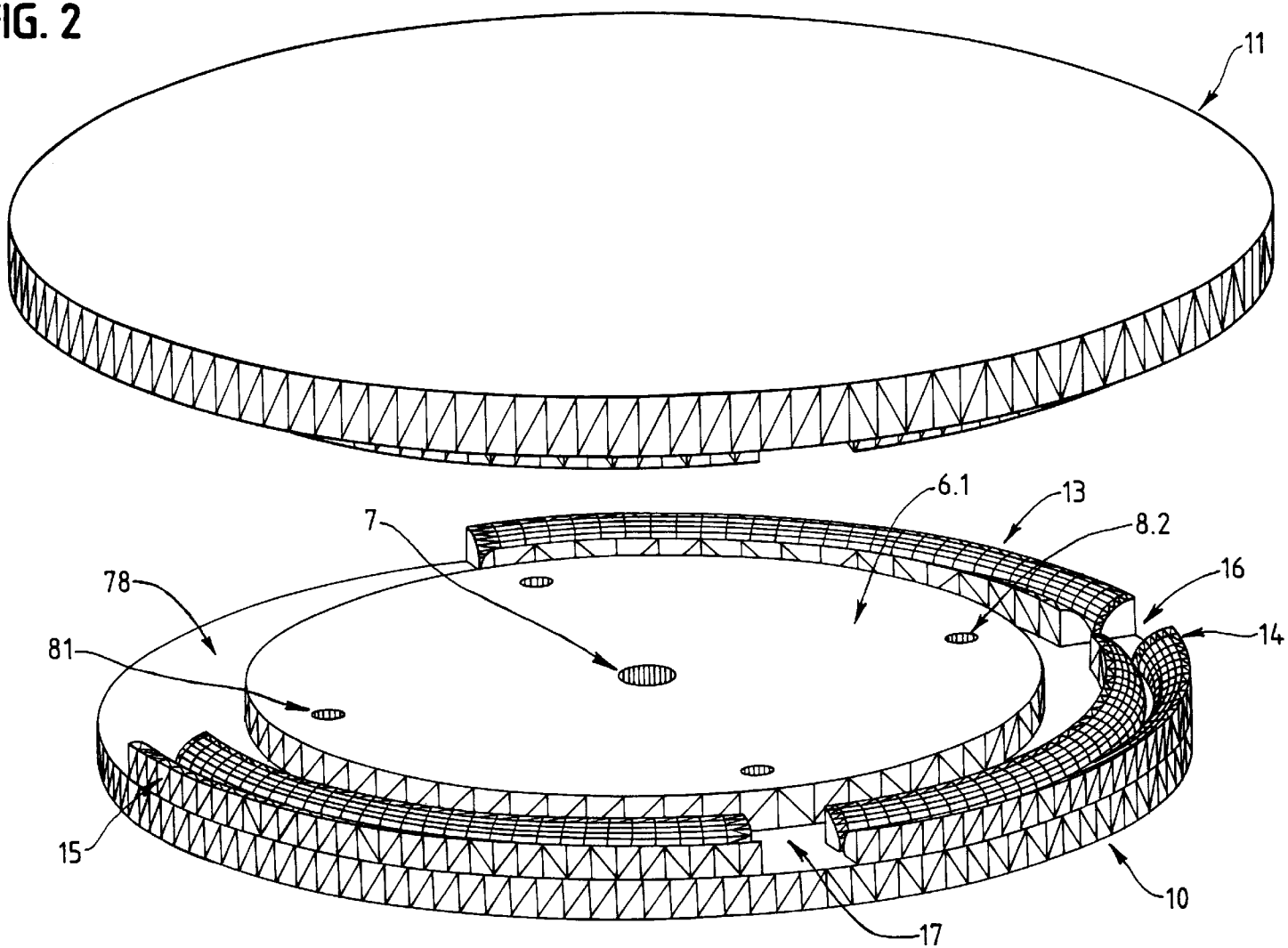
FIG. 2 is a schematic perspective of two shaped parts which can be joined together.

FIGS. 1*a–c* illustrate the essential steps of the process according to the invention. In FIG. 1*a*, a metal plate 1 (e.g. made of steel or aluminum) is first glued and/or screwed to a carrier 2 made of an insulating material (e.g. glass). The metal plate 1 and the carrier 2 are e.g. disk-shaped. They may have the same diameter, but this is not obligatory. The dimensions of the metal plate 1 depend on the quadrupole electrode arrangement to be produced. The thickness is e.g. in the region of 1 cm and the diameter is in the region of 5–50 cm, especially 10–30 cm.

The blank shown in FIG. 1*a* is clamped in the chuck 3.1, 3.2 of a digitally controlled milling machine (FIG. 1*b*). The desired electrode surfaces 4.1–4.4 are then machined out of said blank. In the sectional representation shown in FIG. 1*b*, they have a hyperbolic shape. The electrode surfaces 4.1–4.4 are moreover designed in the shape of a circular arc in a plane perpendicular to the plane of the drawing. In this Example, the electrode surfaces 4.1, 4.2 on the one hand and 4.3, 4.4 on the other belong to two different ion filters connected to one another in series, but it is perfectly conceivable in a different embodiment for the electrode surfaces 4.1, 4.4 and 4.2, 4.3 to constitute a single continuous surface. In this case the ion filter would form a circular arc of more than 180°.

A coupling surface 6.1 is ground in the central region inside the electrode surfaces 4.2 and 4.3. Said coupling surface must be electrically separated from the electrode surfaces 4.2, 4.3 by an annular insulating region 5. In the insulating region 5 and between the electrode surfaces 4.1 and 4.2 and, respectively, 4.3 and 4.4, the metal plate 1 is milled right down to the carrier 2. For this reason the metal plate 1 and the carrier 2 must if possible be bonded together over their whole area or at specific points so that individual parts of the metal plate cannot fall off the carrier on milling.

A central bore 7 and several bores 8.1, 8.2 are also made; these pass right through both the metal plate 1 and the carrier 2. They are subsequently used to join two shaped parts together, as shown in FIG. 1*c*. An expanding arbor 9 is inserted into the central bore 7. It aligns the two shaped parts 10, 11, which essentially have mirror symmetry (and are produced by the process shown in FIGS. 1*a, b*).

The mutual distance between the electrode surfaces 4.1, 4.2 and 4.5, 4.6 etc. is determined by the high-precision grinding of the joined coupling surfaces 6.1, 6.2 of the two shaped parts 10, 11, ensuring that there is an insulating gap between opposing electrode surfaces 4.1, 4.5 and 4.2, 4.6. Contact over the whole area of the coupling surfaces 6.1, 6.2 is provided by the clamping screws 12.1, 12.2.

The Example which has now been described is distinguished in particular by the following advantages:

a) Several electrode surfaces are formed on a single shaped part and can be machined in one chucking. All the shapes which can be machined within one chucking can be produced with very high precision, accurately determining the geometric distances between the different surfaces.

b) Any unevennesses between the metal plate (1) and the carrier (2) can be compensated by applying glue.

c) The quadrupole electrode arrangement is produced by joining together only two shaped parts machined by the same process. Inaccuracies due to assembly can be reduced to a minimum.

d) In principle, the quadrupole interior chamber is already fairly accurately defined by a single shaped part because it is determined relative to the coupling surface 6.1 by the V-shaped recess between the electrode surfaces 4.1, 4.2. Each of the two shaped parts 10, 11, with mirror symmetry, forms or contains half of the quadrupole interior chamber. In this way, said chamber is much more accurately defined than in the state of the art.

e) Because only two shaped parts (and not a large number as in the state of the art) have to be joined together, the expenditure on assembly is comparatively low. Exact positioning is assured by the expanding arbor. A further gain in terms of accuracy is derived from the fact that the shaped parts are joined to one another directly and not via an additional fixing member.

f) The quadrupole electrode arrangement is easily scalable. In other words, the milling data can be calculated by computer, scaled to the desired size and then executed by a CNC machine. If, for example, an electrode arrangement of larger radius of curvature is required, it is only necessary to calculate and transfer the new milling data and clamp a blank of appropriate size in the chuck. As regards assembly, on the other hand, nothing needs to be changed.

g) In the case of a revision, the double plate construction can be separated into the two shaped parts without excessive expenditure.

As shown in FIG. 2, three sectors 13, 14, 15, separated by slots 16, 17, can be formed on the shaped parts 10, 11. Each of these sectors 13, 14, 15 forms an ion filter and filters the ions coming into the quadrupole arrangement. Apertures can be inserted into the slots 16, 17 in the radial direction so that the ion beam is focused better on the inlet side of the next sector. The sectors 13, 14, 15 occupy only about ¾ of the circular arc. The remaining quarter is a free sector 18 (for the input and output of the ion beam).

In a particularly preferred embodiment, the middle sector 14 is designed as a collision cell, i.e. this sector 14 is separated from the others and filled with an inert gas.

Figure 3:
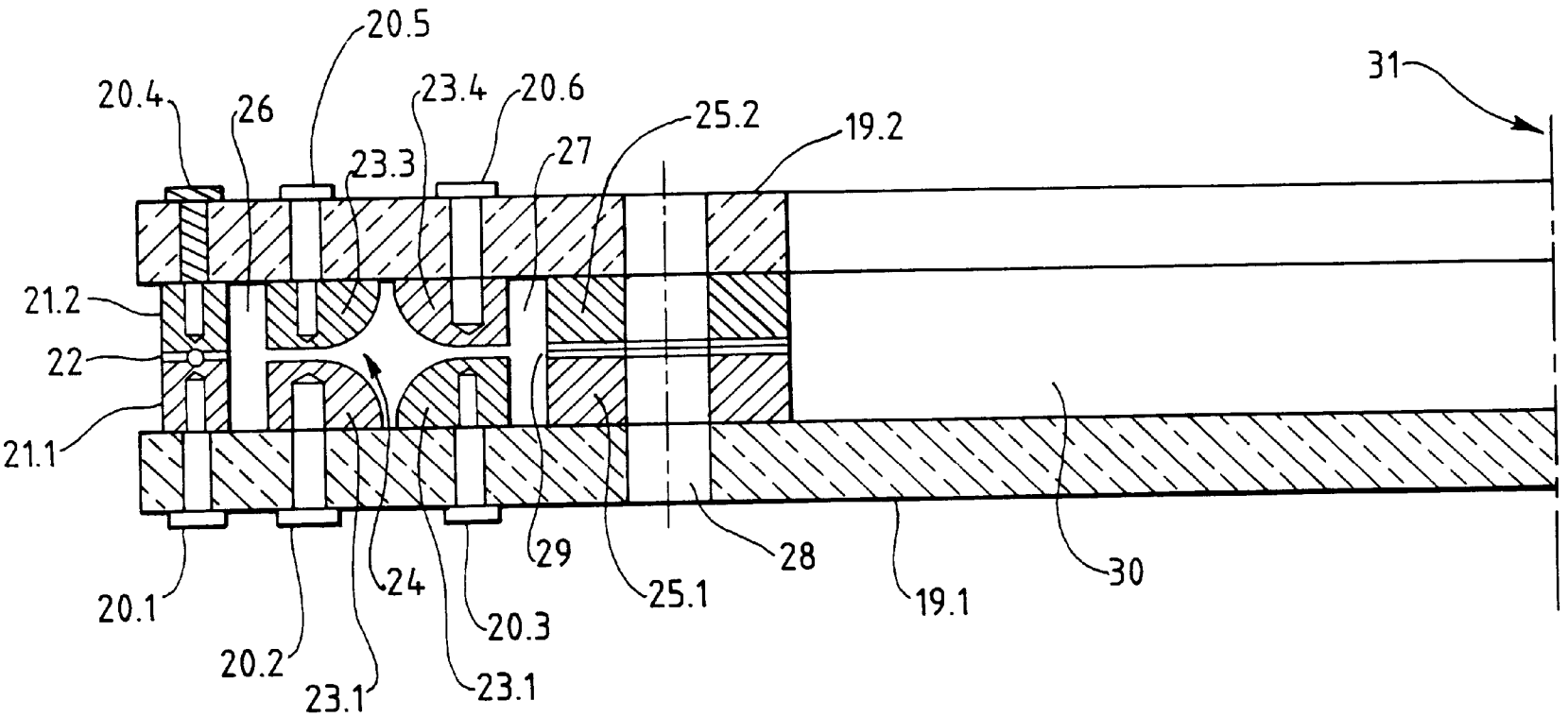
FIG. 3 is a schematic representation of a circular quadrupole electrode arrangement in section.

The functional design of a mass spectrometer (including collision cell) is known from the state of the art and does not require further explanation here. FIG. 3 shows an embodiment with integrated vacuum system. It is known that the quadrupole interior chamber 24 must be evacuated in operation. Instead of placing the entire quadrupole electrode arrangement in an evacuated volume, specific sealed interior chambers between the shaped parts can be selectively connected to an ultrahigh vacuum pump.

FIG. 3 shows a cutout of the construction according to the invention, comprising two carrier plates 19.1, 19.2 with the various parts between them. The outermost parts (relative to the central axis 31 of the carrier plates 19.1, 19.2, shown on the right in FIG. 3) are two spacers 21.1, 21.2 with a seal 22 between them. The electrodes 23.1–23.4, which are further in along the radius, are thus located in a volume (insulating region 26, 27 and quadrupole interior chamber 24) which is gastight to the outside. Said volume can be pumped out via a plurality of radial channels 29 in the spacers 25.1, 25.2. The radial channels 29 are connected e.g. to a large slot-shaped opening 28 running through the carrier plates 19.1, 19.2 in the direction of the central axis 31.

In this Example, the spacers 21.1, 21.2, 25.1, 25.2 and the electrodes 23.1–23.4 are rigidly joined to the carrier plates 19.1, 19.2 by screws 20.1–20.6. In the central region between the carrier plates 19.1, 19.2, provision can be made for an empty space 30 into which the electronics for controlling the quadrupole electrode arrangement can be integrated. The electric cables between this control switch and the electrodes 23.1–23.4 can be brought out parallel to the screws 20.2, 20.3, 20.5, 20.6, through the carrier plates 19.1 and 19.2, and connected to the switch from there.

It is understood that the individual features of the different Examples can be combined in a very wide variety of ways. Accordingly it is possible to meet a very wide variety of user requirements.

In summary, it should be emphasized that the invention has provided a manufacturing process which allows high-precision positioning of the electrodes with minimal expenditure on assembly. In economic terms, this also reduces the production costs. The devices produced in this way are very compact and facilitate the mobile use of mass spectrometers.

What is claimed is:

1. Process for producing a quadrupole electrode arrangement comprising two shaped parts (10, 11), each of which has two electrode surfaces (4.1, 4.2; 4.3, 4.4) machined out of it and at least one coupling surface (6.1, 6.2), so that, when the shaped parts (10, 11) are joined together at the coupling surfaces (6.1, 6.2), the electrode surfaces (4.1–4.4) delimit a desired quadrupole interior chamber (24), characterized in that the two shaped parts (10, 11) are produced from a plate-shaped carrier (2) made of an insulating material and a metal blank (1) attached thereto.

2. The process according to claim 1, characterized in that the two shaped parts (10, 11) are formed essentially with mirror symmetry.

3. The process according to one of claim 1 or 2, characterized in that the carrier (2) is made of glass and the blank (1) is made of steel.

4. The process according to claim 3, characterized in that the two shaped parts (10, 11) are produced from disk-shaped plates and are provided with a central bore (7) so that they can be joined together in alignment.

5. The process according to claim 1 or 2, characterized in that the two shaped parts (10, 11) are produced from disk-shaped plates and are provided with a central bore (7) so that they can be joined together in alignment.

6. A quadrupole electrode arrangement, especially for mass spectrography, constructed from two plate-like shaped parts (10, 11), each of which has two electrode surfaces (4.1, 4.2; 4.3, 4.4) machined out of it and which are joined together via coupling surfaces (6.1, 6.2) in such a way that the electrode surfaces (4.1–4.4) delimit the desired quadrupole interior chamber, characterized in that the two shaped parts (10, 11) are produced from a carrier (2) made of an insulating material and a metal blank (1), out of which the electrode surfaces are machined.

7. The qaudrupole electrode arrangement according to claim 6, characterized in that the shaped parts (19.1, 19.2), joined together, enclose a vacuum-tight interior chamber (24, 26, 27) which can be pumped out via channels (28, 29) provided in the shaped parts (19.1, 19.2).

8. The qaudrupole electrode arrangement according to claim 6 or 7, characterized in that an empty space (30) is provided in the shaped parts (19.1, 19.2) for a control switch.

9. The quadrupole electrode arrangement according to claim 8, characterized in that the shaped parts form several sectors in the shape of a circular arc, with radial slots between them.

10. A mass spectrometer with a quadrupole electrode arrangement according to claim 8.

11. The quadrupole electrode arrangement according to claim 6 or 7 characterized in that the shaped parts form several sectors in the shape of a circular arc, with radial slots between them.

12. A mass spectrometer with a quadrupole electrode arrangement according to claim 11.

13. A mass spectrometer with a quadrupole electrode arrangement according to claim 6 or 7.

* * * * *